United States Patent [19]

Nitta

[11] Patent Number: 4,810,187

[45] Date of Patent: Mar. 7, 1989

[54] PIEZOELECTRIC TYPE LIGHTER FOR USE IN LIGHTING PIPES

[75] Inventor: Tomio Nitta, Kanagawa, Japan

[73] Assignee: Tokai Corporation, Yokohama, Japan

[21] Appl. No.: 132,242

[22] Filed: Dec. 14, 1987

[30] Foreign Application Priority Data

Dec. 25, 1986 [JP] Japan ..... 61-198359[U]

[51] Int. Cl.[4] ..... F23Q 7/12

[52] U.S. Cl. ..... 431/255; 431/344

[58] Field of Search ..... 431/131, 132, 255

[56] References Cited

U.S. PATENT DOCUMENTS 2,612,033 9/1952 Flamm ..... 431/131

4,471,404 9/1984 Nitta ..... 431/131

*Primary Examiner*—Carroll B. Dority, Jr.

*Attorney, Agent, or Firm*—Armstrong, Nikaido, Marmelstein & Kubovcik

[57] ABSTRACT

Disclosed is a piezoelectric type lighter for use in lighting pipes comprising a fuel storage having a fuel in let valve fixed at its ceiling, a piezoelectric unit, a thumb-pusher fixed to the piezoelectric unit, an operating lever operatively connected to the flame valve and to the thumb-pusher for opening the flame valve in response to depression of the thumb-pusher, a flame nozzle metal having an "L"-shaped channel made therein, and fixed to the flame valve via an intervenient electrically conductive gasket, and a shield cap of insulating material enclosing the flame nozzle metal and carrying a high-potential lead wire, which is exposed in the vicinity of the nozzle tip of the flame nozzle metal at one end of the lead wire, and is connected to the piezoelectric unit at the other end of the lead wire. No extra parts other than flame nozzle metals, conductive rubber gaskets, and insulating shield caps are required for assembling piper lighters. The other parts are compatible with those for cigarette lighters. Thus, parts and assembling lines can be used for their fullest extent, and accordingly the cost of production is reduced to possible minimum.

3 Claims, 2 Drawing Sheets

PIEZOELECTRIC TYPE LIGHTER FOR USE IN LIGHTING PIPES

BACKGROUND OF THE INVENTION

1. Field of the Invention

The present invention relates to a piezoelectric type lighter for use in lighting pipes, which lighter permits a small flame to shoot out from one side of the top of the lighter, thereby making it easy to light pipes.

2. Related Art

A conventional piezoelectric type lighter for use in lighting pipes is different in design from a piezoelectric type lighter for use in lighting cigarettes in that the cigarette lighter is designed to permit a small flame to shoot upward, thereby making it easy to light cigarettes. The pipe lighter is made by asembling parts which are different from those used in assembling the cigarette lighter. This incompatibility is parts requires the design and use of separate assembling lines for the production of pipe and cigarette lighters. The use of incompatible parts and assembling lines disadvantageously increases manufacturing costs.

SUMMARY OF THE INVENTION

One object of the present invention is to provide a piezoelectric type lighter structure for use in lighting pipes, which lighter structure permits the fullest use of parts which are designed for assembling cigarette lighters.

Another object of the present invention is to provide a piezoelectric type lighter structure for use in lighting pipes, which lighter structure permits the fullest use of existing assembling lines for cigarette lighters.

To attain these objects a piezoelectric type lighter structure for use in lighting pipes comprises: a fuel storage constituting a substantial part of a lighter casing, and having a fuel inlet valve fixed at its bottom and a flame valve fixed at its ceiling; a piezoelectric unit responsive to application of pressing force for generating a relatively high potential between its opposite terminals, one of these terminals being grounded to the lighter casing; a thumb-pusher fixed to the piezoelectric unit; an operating lever operatively connected to the flame valve and to the thumb-pusher for opening the flame valve in response to application of pressing force to the piezoelectric unit; a flame nozzle metal having an "L"-shaped channel made therein, and fixed to the flame valve via an intervenient electrically conductive gasket; a shield cap of insulating material enclosing the flame nozzle metal and carrying a high-potential lead wire, one end of which is exposed in the vicinity of the tip of the flame nozzle and the other end is connected to the other high-potential terminal of the piezoelectrc unit. This arrangement permits the fullest use of the parts of cigarette lighter in assembling pipe lighters, and hence the existing assembling lines which are used in assembling cigarette lighters. Accordingly, the cost of production of pipe lighters can be substantially reduced, compared with that which would be involved in using parts and assembling lines both designed exclusively for pipe lighters.

A piezoelectric type pipe lighter structure according to a preferred embodiment of the present invention is described below with reference to the accompanying drawings:

PREFERRED EMBODIMENT

Figure 1:
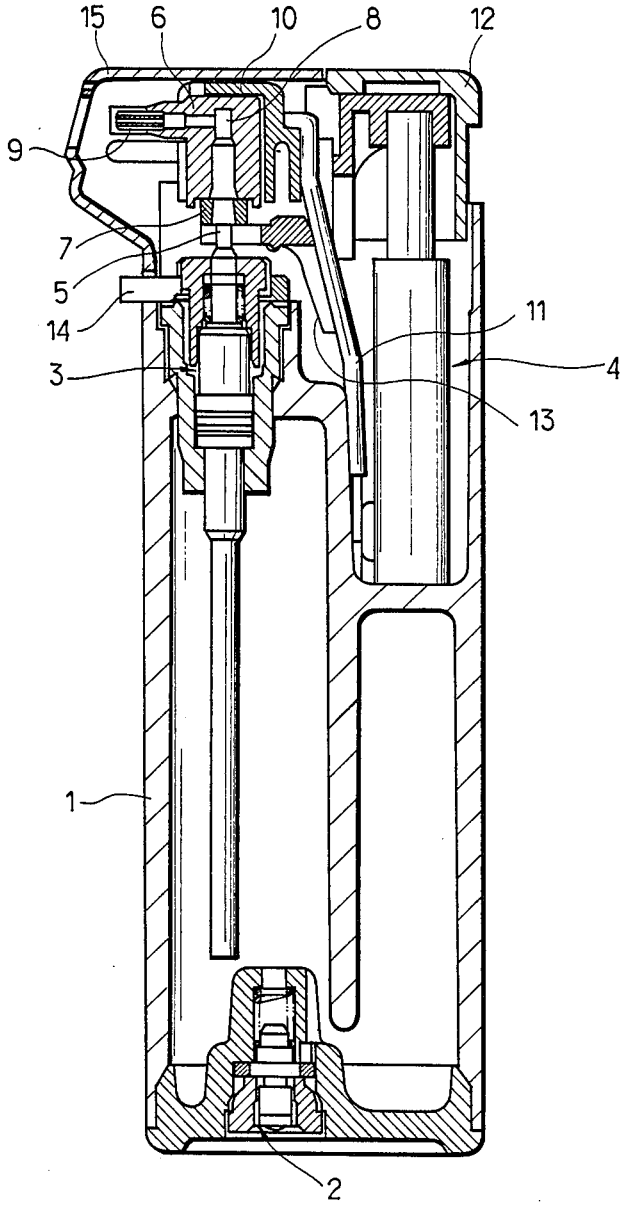
FIG. 1 is longitudinal section of a piezoelectric type pipe lighter structure according to a preferred embodiment of the present invention.
Figure 2:
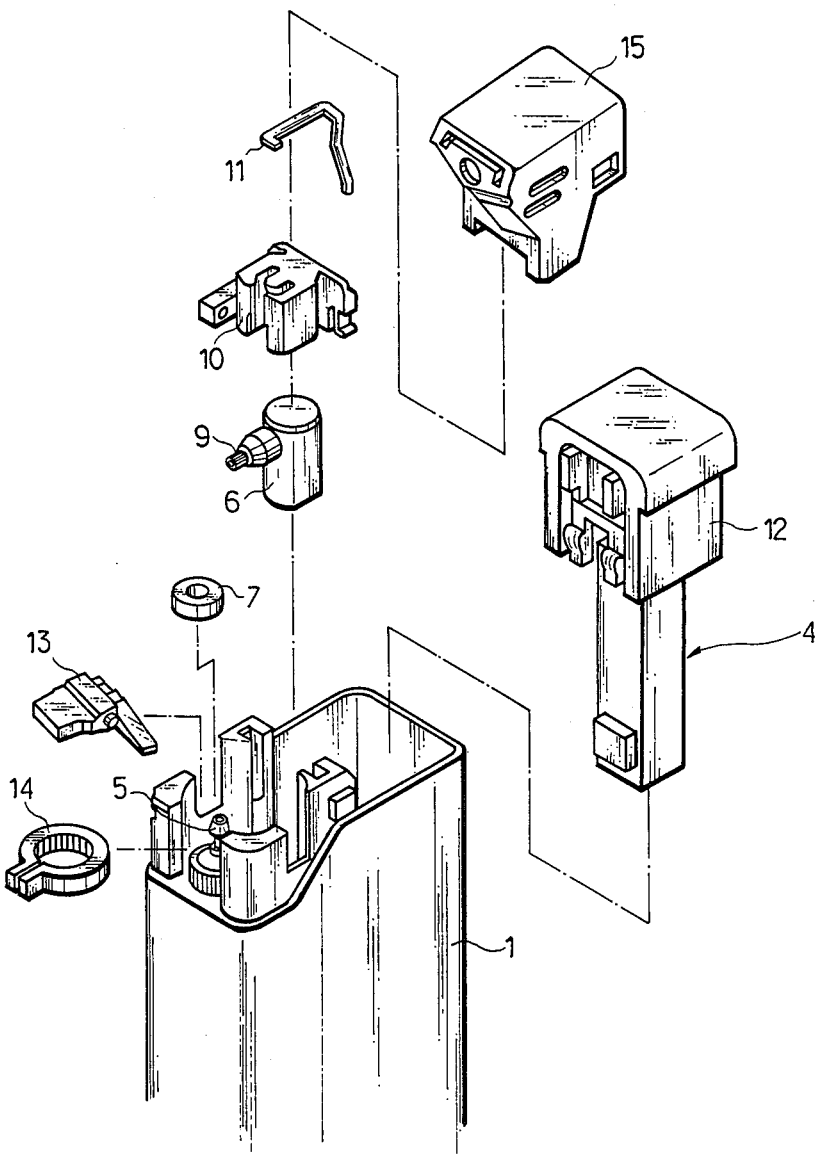
FIG. 2 is an explosive view of the pipe lighter of FIG. 1.

Referring to the drawings, a fuel storage 1 conssutes a substantial part of a lighter casing. The fuel storage 1 has a fuel inlet valve 2 fixed at its bottom and a flame valve 3 fixed at its ceiling. A piezoelectric unit 4 is responsive to application of pressing force for generating a relativey high potential between its opposite terminals. One of these terminals is grounded to the lighter casing. A high-potential lead 11 is connected to the other terminal of the piezoelectric unit 4. A thumb-pusher 12 is fixed to the piezoelectric unit 4. An operating lever 13 is operatively connected to the nozzle 5 of the flame valve 3 and to the thumb-pusher 12 for opening the flame valve in response to application of pressing force to the piezoelectric unit 4. A flame nozzle metal 6 has an "L"-shaped channel 8 made therein. The metal 6 is fixed to the nozzle 5 of the flame valve 3 via an intervenient electrically conductive rubber gasket 7. A shield cap 10 is made of insulating material. It encloses the flame nozzle metal 6 and carries the high-potential lead wire 11. The stripped end of the high-potential lead wire 11 is pushed into a small hole of the shield cap 10 to appear in the vicinity of the nozzle tip 9 of the flame nozzle metal 6. The insulating shield cap 10 is effective in isolating the stripped end of the high-potential lead wire 11 from the grounded flame nozzle metal 6.

A protecting cap 15 is detachably fixed to the lighter casing to enclose the shield cap 10. As shown, the protecting cap 10 is flush with the thumb-pusher 12 in its stress-free position, and the protecting cap 15 has a flame hole in allignment with the nozzle tip 9 of the flame nozzle metal 6. A flame control ring 14 is attached to the flame valve 3 for extending or shortening the flame.

In lighting a pipe the thumb-pusher 12 is depressed. Then, the lever 13 is tilted about its pivot to raise the nozzle 5 of the flame valve 3, thereby opening the flame valve 3 for ejecting the fuel gas from the nozzle tip 9. At the same time the piezoelectric unit 4 is stressed to produce a high-potential, thereby causing an electric arc to appear between the stripped end of the high-potential lead wire 11 and the nozzle tip 9. Thus, the ejected fuel gas is burnt, and a flame is produced to shoot out sideward.

As described above, a piezoelecric type lighter structure for use in lighting pipes according to the present invention uses a flame nozzle metal 6 having an "L"-shaped channel made therein and fixed to the nozzle 5 of the flame valve 3 via an intervenient electrically conductive rubber gasket 7, and a shield cap 10 of insulating material, enclosing the flame nozzle metal 6 and carrying the high-potential lead wire 11. No extra parts are required for assembling pipe lighters. The other parts are compatible with those for cigarette lighters. Thus, parts and assembling lines can be used to their fullest extent, and accordingly the cost of production is reduced to possible minimum.

What is claimed is:

1. A piezoelectric type lighter for use in lighting pipes comprising:

a fuel storage constituting a substantial part of a lighter casing, and having a fuel inlet valve fixed at its bottom and a flame value fixed at its ceiling;

a piezoelectric unit responsive to application of pressing force for generating a relatively high potential between its opposite terminals, one of these terminals being grounded to the lighter casing;

a thumb-pusher fixed to the piezoelectric unit;

an operating lever operatively connected to the flame valve and to the thumb-pusher for opening the flame valve in response to application of pressing force to the piezoelectric unit;

a flame nozzle metal having an "L"-shaped channel made therein, and fixed to the flame valve via an intervenient electrically conductive gasket; and a shield cap of insulating material enclosing the flame nozzle metal and carrying a high-potential lead wire, one end of which is exposed in the vicinity of the nozzle tip of the flame nozzle metal and the other end is connected to the other high-potential terminal of the piezoelectric unit.

2. A piezoelectric type lighter for use in lighting pipes as claimed in claim 1 wherein said intervenient electrically conductive gasket is a conductive rubber gasket.

3. A piezoelectric type lighter for use in lighting pipes as claimed in claim 1 wherein it further comprises a protecting cap having a flame hole made therein, and being adapted to detachably fix to the lighter casing to enclose said shield cap with its flame hole in alignment with the nozzle tip of the flame nozzle metal, and being flush with said thumb-pusher in its stress-free position.

* * * * *